United States Patent [19]

Wegscheid

[11] Patent Number: 4,469,233

[45] Date of Patent: Sep. 4, 1984

[54] TAMPER EVIDENT CLOSURE

[76] Inventor: Stanley C. Wegscheid, 200 Riverview Dr., LaBelle, Fla. 33935

[21] Appl. No.: 474,139

[22] Filed: Mar. 10, 1983

[51] Int. Cl.[3] ..... B65D 55/02

[52] U.S. Cl. ..... 215/230; 215/252

[58] Field of Search ..... 215/252, 250, 253, 365, 215/230, 203

[56] References Cited

U.S. PATENT DOCUMENTS 2,054,031 9/1936 Conner et al. ..... 215/252

*Primary Examiner*—Donald F. Norton

*Attorney, Agent, or Firm*—Alfred E. Wilson

[57] ABSTRACT

Difficulties have heretofore been encountered by having unscrupulous persons open containers used to package pills and other medicinal products, prior to the sale to the ultimate customer, and substitute or place in the container poisonous substances which have on occasion resulted in the death of users of the medicinal products. This invention is directed to the provision of a closure member having relatively movable cap members operable when the cap is moved to the container opening position to permanently display an indicator showing that the container has been opened. The ultimate purchaser can thus be protected from purchasing a container which had been opened after being packaged at the factory where the medicinal supplies originated.

9 Claims, 4 Drawing Figures

TAMPER EVIDENT CLOSURE

BACKGROUND OF THE INVENTION

1. Field of the Invention and of the Prior Art

Heretofore virtually all medicinal and many other products have been packaged in containers having simple screw-on or snap-on closures which could readily be opened. As a result of poisinous substances having been introduced into such containers many types of closures to provide a degree of protection against unauthorized opening have been suggested. None of the closures heretofore devised has been fully satisfactory because they were either too complicated and difficult to open and close or they were too expensive. As a result the purchasing public has not been protected against the unauthorized opening of such containers to either place in the container a dangerous substance or to remove a portion of the merchandise packaged therein.

OBJECTS OF THE INVENTION

An object of this invention is to provide an improved closure that will give a clear indication to a prospective customer as to whether or not the container has been opened after it was packaged by the manufacturer.

A further object of the invention resides in the provision of a two part closure for a container wherein a readily observable indicator is provided to show whether or not the container has been tampered with after leaving the manufacturer.

Still another object of the invention is to provide cooperating container and closure members wherein spaced threaded members having different pitch leads are provided to move relative to each other to shift an indicator to show whether or not the container has been opened.

Another object is to provide a container closure having inner and outer relatively movable threaded members to move an indicator carried by one of the threaded members to show whether or not the container has been opened.

BRIEF DESCRIPTION OF THE DRAWINGS

Referring now to the drawings wherein similar reference characters refer to similar parts throughout the several views.

DESCRIPTION OF THE PREFERRED EMBODIMENT

Figure 1:
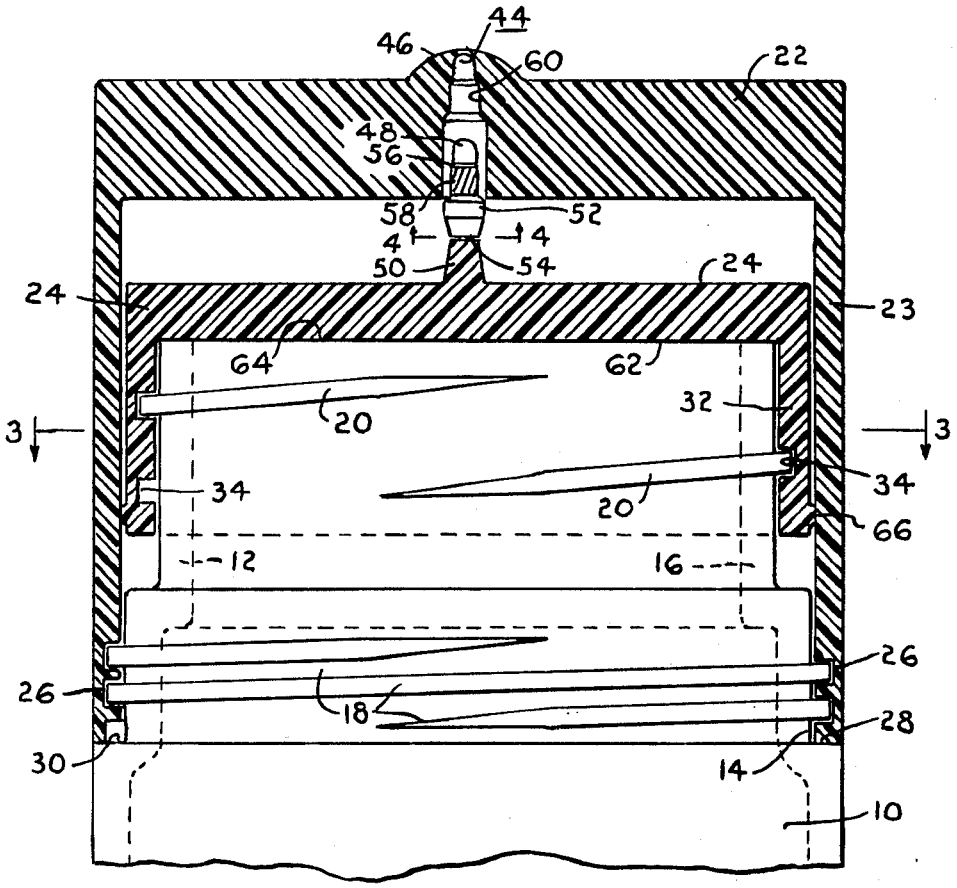
FIG. 1 is a sectional view illustrating the closure member in the fully closed position on the container.

Referring to the drawings, the invention is illustrated as applied to a container 10 having an elongated neck 12 including lower and upper sections of larger and smaller radial diameters 14 and 16. The lower larger diametered section 14 has external threads 18 of low pitch or lead, and the upper smaller diametered section 16 has threads 20 of high pitch or lead.

A two part closure having an outer cap 22 and an inner cap 24 is provided to close the neck 12 of the container 10. The outer cap 22 has a cylindrical section 23 provided with internal or female threads 26 to engage the low pitch threads 18 on the larger diametered section 14 of the neck 12. The outer cap 22 also has a shoulder 28 to engage a flange 30 carried by the container 10 to limit the tightening of the cap 22 on the container 10.

The inner cap 24 has a cylindrical section 32 slidably mounted in the cylindrical section 23 of the outer cap 22. The cylindrical section 32 of the inner cap 24 is provided with internal or female threads 34 to engage the high pitch threads 20 on the upper or smaller diametered section of the neck 12 of the container 10.

Figure 3:
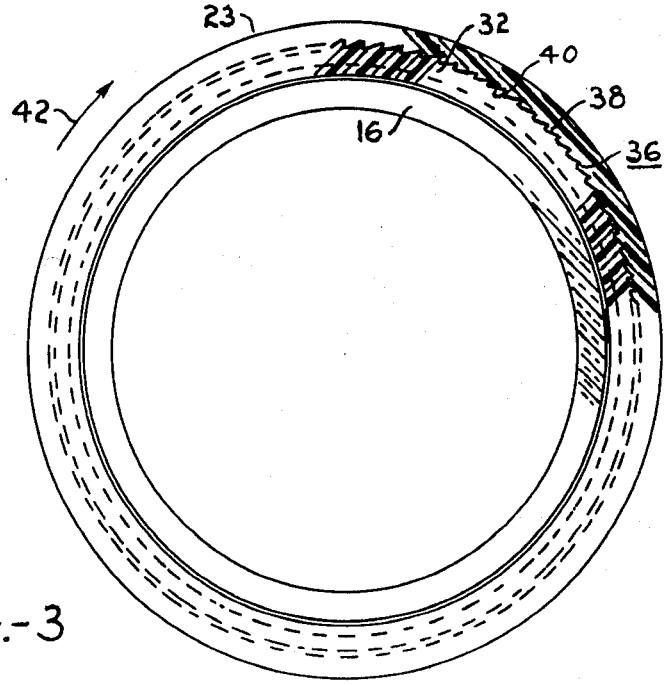
FIG. 3 is a sectional view taken substantially on the line 3—3 of FIG. 1 looking in the direction of the arrows.
Figure 2:
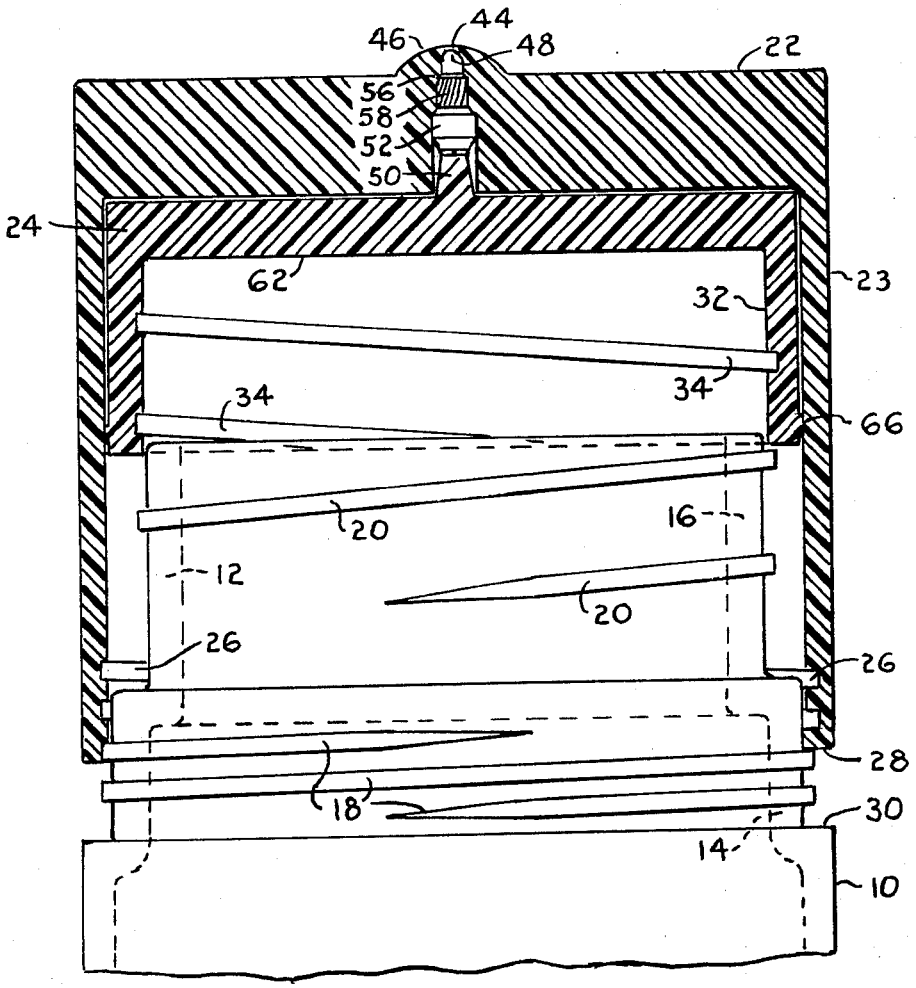
FIG. 2 is a view similar to FIG. 1 showing the closure member in the fully released position on the container preparatory to lifting the closure from the container.

As illustrated in FIG. 3 a frictional overdrive mechanism 36 is provided between the cylindrical section 23 of the outer cap 22 and the cylindrical section 32 of the inner cap 24. The frictional drive mechanism 36 includes cooperating inclined ratchet grooves 38 in the inner surface of the cylindrical section 23 of the outer cap 22 and inclined ratchet teeth 40 on the outer cylindrical section 32 of the inner cap 24. When the outer cap 22 is rotated in the clockwise direction indicated by the arrow 42 on FIG. 3 to tighten the closure on the container 10, the frictional overdrive 36 has an overriding effect when the inner cap 24 is moved downwardly to its fully closed position on the high pitch threads 20 as illustrated in FIG. 3 to permit the further rotation of the outer cap 22 to the fully closed position on the container 10.

Figure 4:
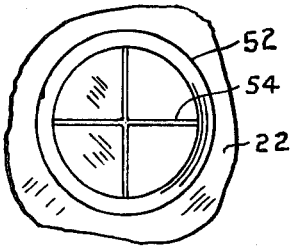
FIG. 4 is a reverse plan view taken on the line 4—4 of FIG. 1 looking in the direction of the arrows.

The outer cap 22 has a central opening 44 covered by a plastic dome 46. An indicator 52 preferably having a rounded ball 48, preferably red is mounted in the center of the top of the inner cap 24, a pedestal 50 being formed in the center of the inner cap 24. The indicator 52 is preferably secured to stand in an upright position on the pedestal 50 in the center of the inner cap 24 by a break-away connector 54 as also shown in FIG. 4. The indicator 52 is shaped in the general configuration of a bulbous bowling pin, and has a substantially straight upper portion 56 having diagonally extending grooves 58 and ridges therebetween will exert a twisting action on the indicator 52 to twist off the break-away connector 54, whereupon the indicator 52 breaks free from the inner cap 24 and remains lodged in the central opening 44 in the outer cap 22 where it is visible through the dome 46.

The operation is as follows. When the container 10 is filled with a medicinal or other product by the manufacturer, the outer cap 22 with the inner cap 24 assembled therein is positioned on the elongated neck 12 of the container and is rotated in the clockwise direction as indicated by the arrow 42 of FIG. 3, either manually or by automatic packaging equipment. The internal threads 26 of the cylindrical section 23 of the outer cap 22 engage the low pitch threads 18 on the larger diametered section 14 of the neck 12 of the container 10. The internal cap 24 is rotated with the outer cap 22 by the frictional override action of the drive 36 between the outer and inner caps 22 and 24. The internal threads 34 in the cylindrical section 32 of the inner cap 24 engages the high pitch threads 20 on the smaller diametered section 16 of the neck 12 of the container 10. It will thus be apparent that rotation of the outer cap 22 screws both the outer cap 22 and the inner cap 24 downwardly on the neck 12 of the container. The inner cap 24 being on the high pitch threads 20 will move down quickly to the sealing position between the inner surface 62 of the inner cap 24 and the top edge 64 of the container 10. When the inner cap 24 thus engages the top edge 64 of the container after about one revolution of the outer cap 22, the outer cap 22 continues to rotate. The frictional overdrive 36 between the outer and inner caps 22 and 24 permitting an overdrive or slipping action between the cylindrical sections 23 and 32 of the outer and inner caps 22 and 24 to permit the outer cap 22 to continue to rotate for approximately another revolution to fully seal the container 10, at which time the shoulder 28 of the cylindrical section 23 of the outer cap 22 engages the flange 30 on the container 10 as illustrated in FIG. 1. When the container 10 is thus fully sealed the indicator 52 stands vertically on the pedestal 50 carried by the inner cap 24, and it is not visible through the dome 46.

When the container is opened the outer cap 22 is rotated in the counterclockwise direction as viewed in FIG. 3 by grasping the cylindrical section 23. As the cylindrical section 23 of the outer cap 22 rotates it is elevated on the low pitch threads 18 on the larger diametered section 14 of the neck of the container 10. The frictional overdrive 36 between the cylindrical section 23 of the outer cap 22 and the cylindrical section 32 of the inner cap 24 rotates the inner cap 24 with the outer cap 22. The high pitch threads 20 on the smaller diametered neck section 16 of the container 10 are engaged in the internal threads 34 of the inner cap 24 and elevate the cap 24 more rapidly than the outer cap 22 is elevated on the low pitch threads 18. The indicator 52 mounted on the pedestal 50 of the inner cap 24 is thus elevated into the reduced diameter area 60 of the outer cap 22 of the central opening 44 in the outer cap 22. The diagonal grooves and ridges therebetween exert a binding action in the reduced diameter area 60 to twist off the break-away connector 54 whereupon the indicator is lodged in and remains in the outer cap 22 where it is visible through the dome 46.

The prospective customer is thus fully protected. If on examination of the container the ball 48 carried by the inner cap 24 is visible in the dome 46 of the outer cap 22 that is evidence that the container has been tampered with and the prospective customer should reject the container.

When the container has been purchased, and the customer opens it by rotating the outer cap 22 the ball 48, preferably red carried by the inner cap 24 should appear in the dome 46 of the outer cap 22. If the ball does not so appear through the dome 46 it is an indication that the container may have been tampered with, and the customer should return it to the point of sale.

If an effort has been made to tamper with the container, as for example by drilling a small hole through the dome 46 to hold the ball 48 down as for example by the use of a blunt instrument, the indicator 52 would be broken loose from the pedestal 50 and fall into the space between the outer cap 22 and the inner cap 24. Then when it is desired to open the container the indicator would lodge between the caps 22 and 24 and would not let the inner cap 24 move up far enough to release the high pitch threads 20 by the time the outer cap 22 rotates far enough to release the low pitch threads 18. A binding would therefore result whereupon it would be impossible to open the container. Since it would then appear that possibly the container may have been tampered with the customer should return it to the point of sale.

Attention is directed to the fact that the cylindrical section 32 of the inner cap 24 is formed with a radially enlarged skirt 66 to engage the inner diameter of the cylindrical section 23 of the outer cap 22 to exert sufficient pressure therein to hold the inner cap 24 assembled in the outer cap 22 when the assembly is removed from the container 10.

I claim:

1. A tamper evident closure for a container having a neck with axially spaced sections of larger and smaller diameters, external threads having a low pitch lead on the larger diametered neck section, external threads having a high pitch lead on the smaller diametered neck section, said closure comprising a two part closure member including an outer cap having internal threads engaging the low pitch external threads on the larger diametered neck section, an inner cap slidably mounted in the outer cap and having internal threads engaging the high pitch external threads on the smaller diametered neck section, frictional overdrive means between the outer and the inner cap, and cooperating indicator means between the inner and outer cap to indicate if the closure has been opened.

2. The invention defined in claim 1 wherein an indicator member carried by the inner cap and visible through the outer cap is provided to indicate if the closure for the container has been opened.

3. The invention defined in claim 2 wherein the indicator carried by the inner cap is connected to the inner cap by a break-away connector and is adapted to project into and be lodged in an aperture in the outer cap.

4. The invention defined in claim 3 wherein diagonal grooves and ridges in the indicator are adapted to actuate the break-away connector when the indicator is projected into the aperture in the outer cap.

5. In combination with a container having a two diametered neck, a two part closure to indicate if the container has been opened comprising an outer cylindrical cap, an inner cylindrical cap telescopically mounted in the outer cap, frictional overdrive means between the outer and inner caps, cooperating low pitch threaded means between the outer cap and the larger diametered neck of the container, cooperating high pitch threaded means between the inner cap and the smaller diametered neck of the container, and cooperating indicator means between the inner and outer caps and visible through the outer cap to indicate if the container has been opened.

6. The invention defined in claim 5 wherein the indicator means is carried by the inner cap and is visible through the outer cap to indicate that the closure for the container has been actuated.

7. The invention defined in claim 6 wherein break-away connecting means is provided between the inner cap and the indicator, and a portion of the indicator is projected into an aperture in the outer cap to indicate when the closure is opened.

8. The invention defined in claim 7 wherein diagonal grooves and ridges are formed in the indicator to exert a twisting break-away action between the indicator and the inner cap when the container is opened.

9. The method of providing a tamper indicating closure for a container having an elongated two diametered neck with low and high pitch threads on the larger and smaller diametered neck portions, comprising providing a two part closure having inner and outer telescoping cylindrical caps adapted to engage the low and high pitch neck threads, providing frictional driving means between the inner and outer caps to move the inner cap outwardly in the outer cap, and providing cooperating means between the inner and outer caps and visible through the outer cap to indicate if the container has been opened.

* * * * *